United States Patent [19]

Lord

[11] Patent Number: 4,506,516

[45] Date of Patent: Mar. 26, 1985

[54] REFRIGERATION UNIT COMPRESSOR CONTROL

[75] Inventor: Richard G. Lord, Liverpool, N.Y.

[73] Assignee: Carrier Corporation, Syracuse, N.Y.

[21] Appl. No.: 597,335

[22] Filed: Apr. 6, 1984

[51] Int. Cl.[3] ..... F25B 5/00

[52] U.S. Cl. ..... 62/117; 62/175; 219/486; 307/41

[58] Field of Search ..... 236/1 EA, 1 EB; 62/175, 62/117; 307/39, 41; 219/486

[56] References Cited

U.S. PATENT DOCUMENTS

| | | | |
|---|---|---|---|
| 4,081,691 | 3/1978 | Evalds et al. | 307/41 |
| 4,100,426 | 7/1978 | Baraowaki et al. | 307/41 |
| 4,419,590 | 12/1983 | Voss | 307/41 |

FOREIGN PATENT DOCUMENTS

| | | | |
|---|---|---|---|
| 78042 | 5/1983 | Japan | 62/175 |

*Primary Examiner*—William E. Wayner

*Attorney, Agent, or Firm*—Robert H. Kelly

[57] ABSTRACT

A method and control system for operating a refrigeration unit to permit random loading and unloading sequences of multiple compressors and unloaders. The random loading and unloading sequences of the two circuits of compressors and unloaders is performed by a microprocessor. A random sequence is selected at start-up and the selected sequence loads the compressors to full load, where upon another random sequence is selected to unload the compressors.

The compressors are also loaded in response to the water temperature leaving the chiller. The leaving water temperature is compensated for by a return water temperature which determines the temperature drop through the heat exchanger. The temperature drop is divided by the number of active stages to determine the drop/stage, which is an indication of how the leaving water temperature will change when a capacity stage is either added or subtracted.

1 Claim, 8 Drawing Figures

REFRIGERATION UNIT COMPRESSOR CONTROL

BACKGROUND OF THE INVENTION

This invention relates to refrigeration systems, and more specifically to a method and apparatus for improving the efficiency, reliability, and manufacturability of the compressor control system for an air conditioning unit.

Conventional refrigeration systems utilize a recirculating refrigerant for removing heat from a low temperature side of the refrigeration system and for discharging heat at a high temperature side of the refrigeration system. The work input necessary to operate the refrigeration system is provided by a motor driven compressor which receives low pressure gaseous refrigerant and compresses it to a high pressure. This high pressure gaseous refrigerant is supplied to a condenser where heat is removed from the gaseous refrigerant to condense it to a liquid. This liquid refrigerant is then supplied through an expansion valve to an evaporator wherein heat is transferred from a heat transfer fluid to the liquid refrigerant to evaporate the liquid refrigerant. The heat transfer fluid is thereby cooled and then used to cool a load, such as to cool a building. The evaporated refrigerant from the evaporator is returned to the compressor for recirculation through the refrigeration system. A control system directs the operation of the air conditioning unit.

Normally, the heat transfer fluid used in an evaporator of a conventional refrigeration system of the type described above is a liquid such as water. Usually, the liquid enters one end of the evaporator, is cooled as it flows through the evaporator, and then exits at another opposite end of the evaporator. It is highly desirable to maintain the heat transfer liquid flowing through the evaporator at a temperature above the freezing temperature of the heat transfer liquid. If the liquid is not maintained above its freezing temperature then the liquid may freeze in the evaporator thereby preventing proper operation of the refrigeration system and possibly damaging the evaporator. This is especially true if the heat transfer fluid is water because water increases in volume when changing state from a liquid to a solid.

The compressor electronic control system is designed to replace the electromechanical control systems of large commercial air conditioners having multiple compressor and unloaders that are cycled on and off to give multiple stages of capacity. The cycling is usually accomplished by a controller that cycles relays on and off in one predetermined sequence. The different loading sequences were accomplished by wiring to the step controller in different ways. The wiring is complicated and requires relays with both normally open and normally closed contacts.

Further, most large chillers are designed with two circuits in order to have a standby operation. Normally, a manual lead/lag switch will allow the operator to field change the compressor loading sequence to equalize the run hours on the lead compressors in each circuit. However, the lead/lag switch usually changes only which circuit will start first and after that the loading sequence is the same.

Still further, most chillers are designed with controls that maintain a constant leaving cooler water temperature. The water temperature is usually set at the temperature required at full load. However, at part load it may not be necessary to maintain the leaving water temperature of the full load set point, because the machine overcools the water and is less efficient. Also, the cycle points for different stages of the compressors are based on a fixed temperature differential to be seen over the complete load range. As this load changes, however, this differential is excessive which results in inaccurate temperature control.

Further, most reciprocating water chillers can supply leaving chilled water within a temperature band of about 5° F., with an additional droop of about 1½ degrees. Fluctuating chilled water temperatures can cause air conditioning control problems, occasionally interfere with good humidity control, and it also can make people uncomfortable. It also can make precise control of industrial processes impossible. The fluctuations stem from controlling only from return water temperature to sense building load.

The present invention controls on leaving chilled water temperature but also senses return water temperature to anticipate building load changes. A microprocessor is programmed to measure both temperature differences and rate of change. From this information the microprocessor commands the compressors. The result is no droop and a better temperature control. Further, the leaving water temperature of the chiller is reset based on the return water temperature, and adjusted by a reset ratio means or potentiometer.

Ability to replace moving parts and flow switches in a control system and have a simple means to allow for the programming of a very sophisticated electronic control during the assembly of an air conditioning unit and in the field would represent a significant savings in the installation and maintenance of the unit and a higher operating efficiency of the unit. Thus, there exists a need for a method and apparatus which utilize electronic components to control the loading and unloading of compressors in an air conditioning unit and to automatically adjust the stage differential temperatures and reset of the leaving water temperature.

SUMMARY OF THE INVENTION

The present invention is directed to a method and apparatus for controlling a refrigeration system.

The control system consists of a processor board which contains a microprocessor that receives and stores information sent to it from other components in the system. A relay board, electrically connected to the processor board, controls the voltage circuits for the compressors and outdoor fan motors. Further, the control system has a compressor protection and control system to control and protect the compressor and a display/set point board with a digital display to communicate with the operator.

The various outputs that are controlled through the relays on the relay board have a display of the outputs located on a display/set point board. To get the different loading sequences from the relays, the logic for controlling the relays has been stored in software and is selected by a unit configuration header, and compressor and unloader jumpers. Various relays also control functions of either circuit No. 1 or circuit No. 2 compressors.

The display set point board is connected to the processor board through a ribbon cable and is used to communicate unit operational information with the operator. Generally, the display set point board is located on the control/gauge panel. The board contains the leaving water set point potentiometer, a two digit display, and a display switch. Through the display, the controls show the stage of capacity, unit operation mode, and diagnostic information.

The objects of the present invention are attained by a method and control system for operating a refrigeration system to randomly select two complete reversed loading sequences selected by a microprocessor. The sequencers allow for lead/lag control of the compressors and the sequences shall be randomly determined by the software and shall be changed whenever the unit becomes fully loaded or unloaded. The loading and unloading of the compressors is controlled by the drop in temperature through the chiller per the active number of stages, the difference in leaving water temperature from the set point temperature and by the rate of change of leaving water temperature. The temperature of the heat transfer fluid leaving the evaporator is sensed and then the temperature of the heat transfer fluid returning to the evaporator is sensed to determine the temperature drop through the heat exchanger. Thus the drop per stage is an indication of how much the leaving temperature will change when a capacity stage is either added or subtracted. Further, the use of two temperature sensors allows the leaving water temperature to be reset based on return water temperature.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designating like or corresponding parts throughout the same.

DESCRIPTION OF THE PREFERRED EMBODIMENT

Figure 1:
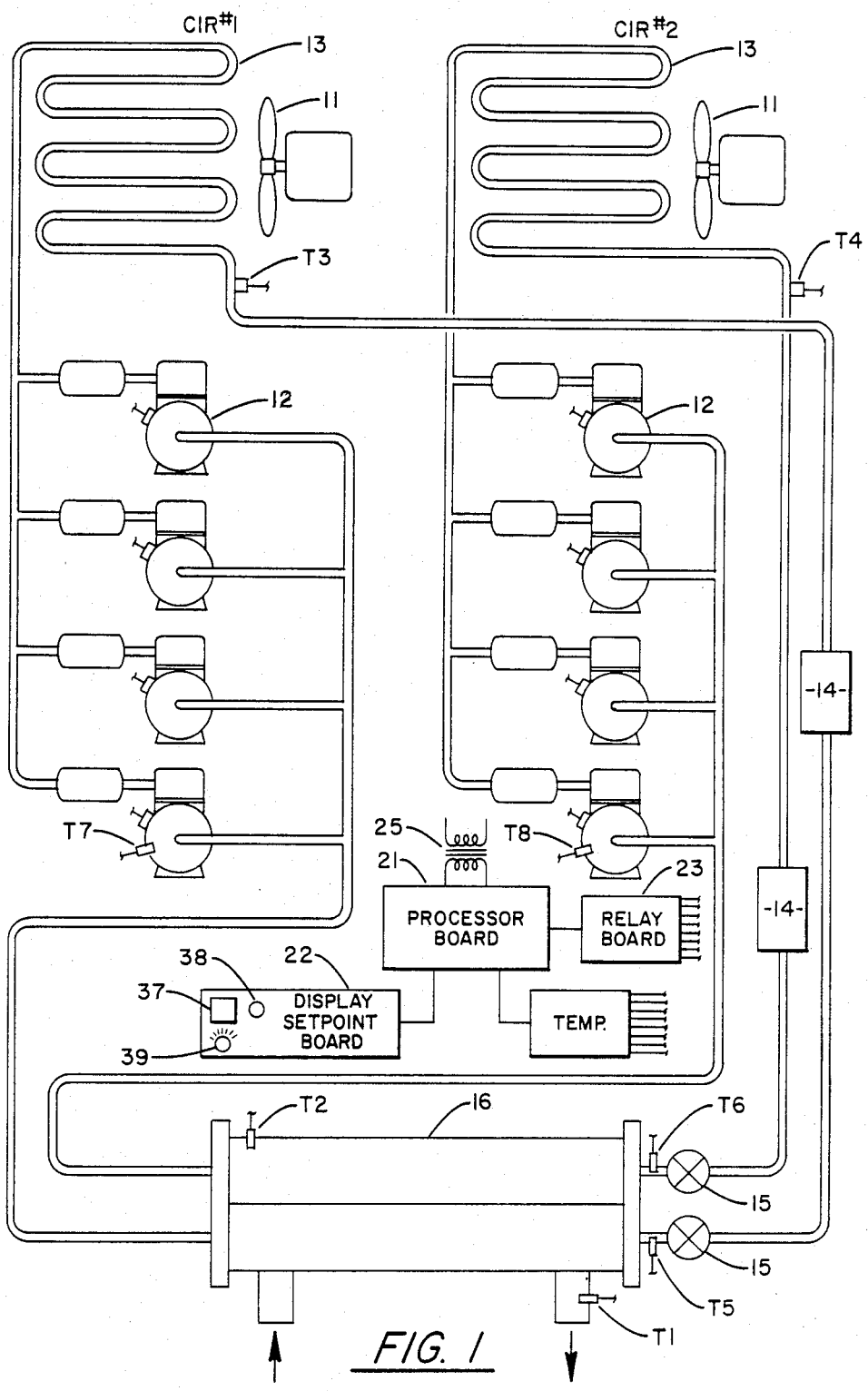
FIG. 1 is a schematic representation of a dual circuit refrigeration system with a control system for operating the refrigeration system.

The present invention relates to an electronic control system for a refrigeration system. As shown in FIG. 1, the refrigeration system comprises two circuits each having a plurality of compressors 12, an air-cooled condenser 13 (cooled by fan 11), a filter-dryer 14, and expansion valve 15, and a dual circuit cooler 16 all connected in the usual manner. Also, as shown in FIG. 1, the control system comprises a processor board 21, a display/set point board 22, a relay board 23, an accessory reset board 24, control transformer 25 and a plurality of thermistors.

The processor board 21 generally contains a microprocessor, a power supply, A/D converters, expansion valve drivers, relay drivers, and display drivers. The microprocessor may be any device or combination of devices, suitable for receiving input signals, for processing the received input signals according to preprogrammed procedures, and for generating control signals in response to the processed input signals. The control signals generated by the microprocessor are supplied to control devices which control the operation of the refrigeration system in response to the control signals provided to the control devices from the microprocessor. Preferably, the microprocessor is a model 8031 manufactured by Intel Corporation, having an external eprom memory module. A masked version of the model 8031, i.e. a model 8751 is also suitable.

The processor board 21 is a generic control board for use with various refrigeration systems. To determine the configuration of the processor board 21 to be used with a specific refrigeration system, i.e. the type of unit, the number of compressors, or the type of expansion valve, a configuration header 30 is used to correlate the processor board to the specific physical characteristics of the refrigeration unit. The configuration header 30 contains a plurality of small wires, e.g. eight jumpers, that are selectively broken to set the configuration of the processor board 21.

Figure 2:
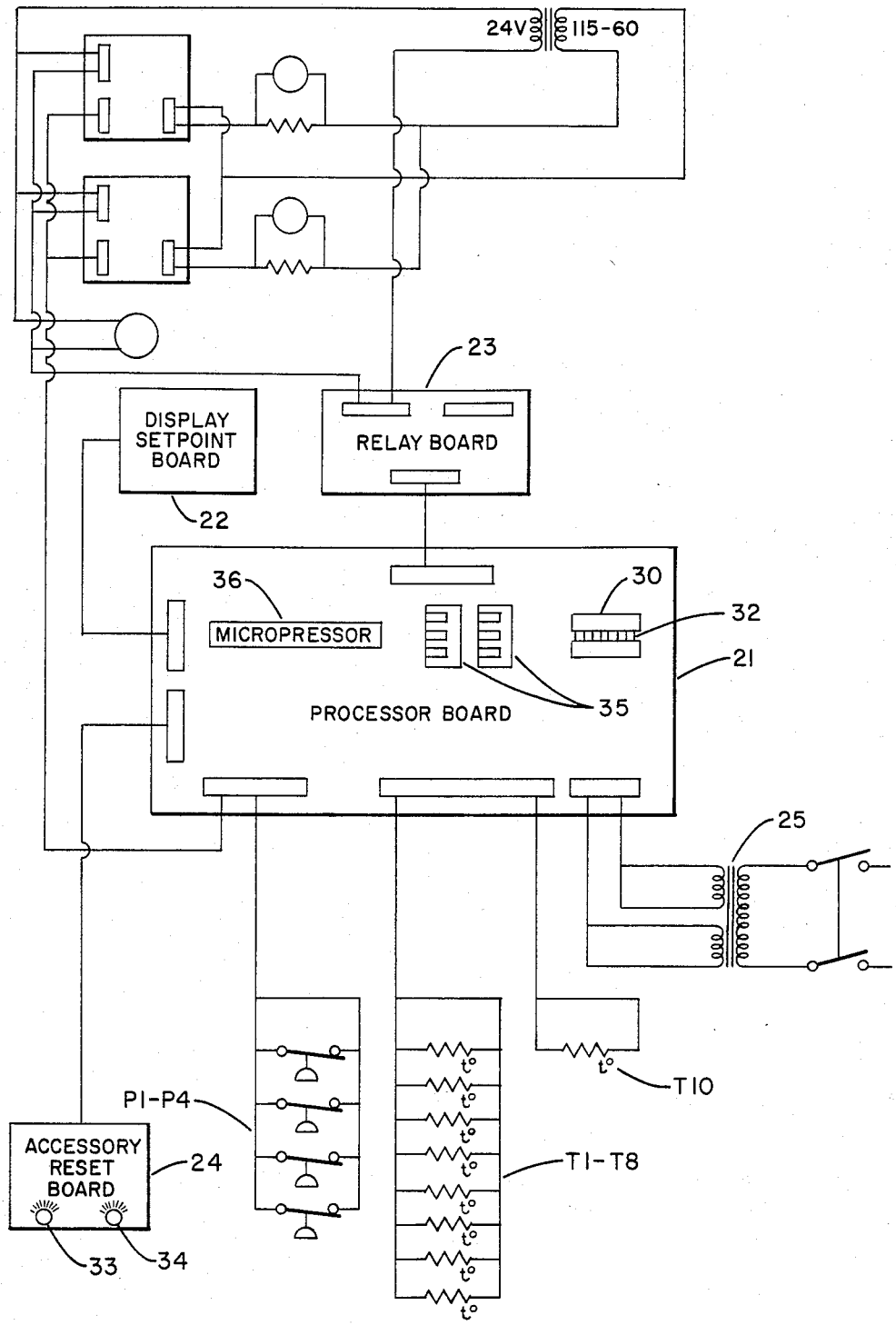
FIG. 2 is a schematic representation of the electronic control circuit of the refrigeration system shown in FIG. 1.

In FIG. 2 the processor board 21 is shown with its various inputs and outputs for controlling the refrigeration unit.

The processor board may also contain a plurality of small DIP switch assemblies 35 intended to be used in the field to select the field programmable options. The options may include unloaders, brine temperature, pull-down selection, and return water temperature reset. The DIP switches 35 are generally ON-OFF switches connecting various set point controls to field thermistors or resistance temperature detectors. All set point adjustments, after the corresponding DIP switch 35 is turned to the proper position are made through field adjustable potentiometers. To be able to detect faulty potentiometers a valid potentiometer range of 10 to 95% of potentiometer travel has been established. If the potentiometer is outside the 10 to 95% range, then an alarm will be energized and the control will automatically transfer to its failsafe condition.

Further, as shown in FIG. 2, the processor board 21 is electrically connected through electrical connectors to various inputs and outputs. Temperature signals indicative of sensed temperatures are supplied by way of electrical lines to the processor board 21. The various input thermistors and their locations are as follows:

| INPUT THERMISTORS | | |
|---|---|---|
| THERMISTOR NAME | FUNCTION | LOCATION |
| T1 | LEAVING COOLER WATER | LEAVING WATER NOZZLE |
| T2 | ENTERING COOLER WATER | ENTERING WATER BAFFLE SPACE |
| T3 | SATURATED CONDENSING TEMP. CIR. 1 | RETURN BEND OF LAG COIL |
| T4 | SATURATED CONDENSING TEMP. CIR. 2 | RETURN BEND OF LAG COIL |
| T5 | COOLER SATURATED SUCTION TEMP. CIR. 1 | COOLER HEAD NEAR LIQUID NOZZLE |
| T6 | COOLER SATURATED SUCTION TEMP. CIR. 2 | COOLER HEAD NEAR LIQUID NOZZLE |
| T7 | SUPERHEAT GAS ENTERING PISTON CIR. 1 | LEAD COMP. CIR. 1 |
| T8 | SUPERHEATED GAS ENTERING PISTON CIR. 2 | LEAD COMP. CIR. 2 |
| T10 | RESET TEMPERATURE | OUTSIDE AIR OR BUILDING INSIDE AIR |

The processor board 21 uses the temperature readings to control capacity, of the compressors in a refrigeration unit.

Preferably, the temperature sensors are two different types. The first type is used to sense saturated condensing temperature (T3–T4) and is attached to a return bend of a condenser coil. The second type of temperature sensors are used to sense refrigeration temprature (T5–T8) and water temperature (T1–T2). The probe assembly is inserted directly into the refrigerant circuit or water loop and secured there by normal means. The saturated temperature sensor, however, is generally clamped to the outside of a return bend on the coil.

A relay board 23 controls the contacts for the 24 and 115 or 230 volt circuits of the output relays to control the compressors and unloaders in order to define the loading and unloading sequence of the compressors. The relays are energized by the processor board through a ribbon cable. The sequences to be used to load and unload the compressors are programmed into the microprocessor on the processor board. Generally, one-half of the relays will be used to control the circuit number 1 compressors and unloader while the other half of the relays are used to control circuit number 2 compressors and unloader. Two basic chiller compressor loading sequences are defined in order to allow for lead-lag control of the compressors. Lead-lag is used to equalize the run time on the compressors. The lead-lag control sequence shall automatically be selected by the software. The sequence is randomly determined after the unit is turned on and is changed whenever the unit becomes fully loaded or fully unloaded.

The actual sequence of compressor loading is determined through the configuration header 30 and the DIP switches 35 on the processor board 21. The configuration header 30 tells the processor the number of compressors in the unit and the DIP switches 35 let the processor know if there are unloaders or other accessories installed on the unit. For each unit there are two loading sequences possible, A or B, as shown here in Table 1.

TABLE 1

| (LOADING SEQUENCE) | | |
|---|---|---|
| Stage | Cir. 1 | Cir. 2 |
| | A | |
| 1 | Comp. 1 | |
| 2 | 1 | Comp. 5 |

TABLE 1-continued

| (LOADING SEQUENCE) | | |
|---|---|---|
| Stage | Cir. 1 | Cir. 2 |
| 3 | 1,2 | 5 |
| 4 | 1,2 | 5,6 |
| 5 | 1,2,3 | 5,6 |
| 6 | 1,2,3 | 5,6,7 |
| 7 | 1,2,3,4 | 5,6,7 |
| 8 | 1,2,3,4 | 5,6,7,8 |
| | B | |
| 1 | | Comp. 5 |
| 2 | Comp. 1 | 5 |
| 3 | 1,2 | 5,6 |
| 4 | 1,2 | 5,6 |
| 5 | 1,2 | 5,6,7 |
| 6 | 1,2,3 | 5,6,7 |
| 7 | 1,2,3 | 5,6,7,8 |
| 8 | 1,2,3,4 | 5,6,7,8 |

The processor will randomly select which sequence to use to help even the wear on the compressors. For example: If loading sequence A is chosen, compressor 1 will be energized first; if sequence B is chosen, compressor 5 is energized first. Also, when capacity stages are being removed after the unit has been fully loaded, the control will again randomly select sequence A or B. This results in a true automatic lead/lag.

If one lead compressor in a circuit stops, the processor locks out the entire circuit. However, if a lockout occurs in any other compressor, only that compressor will be locked out.

The sequences to be used to load and unload the compressors 12 shall be programmed into the microprocessor memory. Each compressor and unloader will be connected to one of the output relays (K1 to K8).

The loading sequence for the unit being controlled is determined from the status of the jumpers of the DIP switches 35.

In order to define the loading and unloading sequences, each of the 8 output relays, one associated with each compressor, has been assigned to one bit of an 8 bit word as follows:

| Bit # | 7 | 6 | 5 | 4 | 3 | 2 | 1 | 0 |
|---|---|---|---|---|---|---|---|---|
| Relay | K8 | K7 | K6 | K5 | K4 | K3 | K2 | K1 |

A "1" in a given bit location indicates that the relay associated with that bit is to be energized. All the compressor relays will have normally open contacts. When the relay is energized, the contacts will close and turn on the associated compressor or unloader. When a compressor unloader is energized, the compressor is unloaded (capacity decreases).

The same loading sequences can be used for air-cooled chillers, water-cooled chillers and heat machines. Relays K1, K2, K3 and K4 will be used to control the circuit #1 compressors and unloader. Relays K5, K6, K7 and K8 will be used to control the circuit #2 compressors and unloader. Two unloaders will be used with only one unloader being allowed per circuit. The first unloader will be in circuit #1, and will connect to relay K4. The second unloader will be in circuit #2 and will be connected to relay K8. Use of 0, 1 or 2 unloaders will occur with 2, 3, 4, 5 or 6 compressors. No unloaders will be used with 7 and 8 compressors.

The two basic sequences (Table 1, #A and #B) are defined in order to allow for lead/lag control of the compressors. Lead/lag is used to equalize the run time on compressors. The lead/lag control sequence (A or B) shall automatically be selected by the software. It shall be randomly determined after power on reset and shall be changed whenever the unit becomes fully loaded or fully unloaded. The A and B sequences are different for 0 and 2 unloader machines, but are the same for 1 unloader machines.

In all sequences, the first compressor in each circuit must be turned on before any other compressor in that circuit is started. It must also remain on if any other compressor in the circuit is to operate.

The display/set point board 22 is generally connected to the processor board 21 through a ribbon cable. Preferably, the board contains a digital display 37, a display switch 38 for energizing the digital display, and a set point potentiometer 39 for adjusting the leaving water temperature set point. Further, a display switch 38 is used in conjunction with the LED display to show the stage of capacity, control system status, and diagnostic information. The diagnostic information is generally displayed on the two digit LED display in numbered codes. Accordingly, the diagnostic information including either operating status information or overload information will automatically be displayed on the LED. The display will rotate every two seconds and overload information will take priority over all other codes.

The capacity of the chiller is controlled by the microprocessor by cycling compressors and unloaders on and off at a maximum cycle rate of once every ten minutes. Under most operating conditions, cycle time will be considerably longer. The control tries to maintain the leaving water set point temperature through intelligent cycling of the compressors. The accuracy will depend on the loop volume, loop GPM, load, outdoor air temperature, number of stages and the stage being cycled on and off. The only required field adjustment is the set point which is adjusted by the set point potentiometer 39 located on the set point board 22. No adjustments for cooling range or cooler flowrate are required because the control automatically compensates for the cooling range through a return water sensor. This is referred to as leaving water control with return water temperature compensation.

Two sensors, the leaving water temperature (T1) and the entering water temperature (T2) are used to control the capacity. The primary control sensor is T1. This entering water temperature is used to determine the temperature drop through the chiller 16. The temperature drop through the heat exchanger is then divided by the active number of stages to determine the rise/stage. The temperature drop per stage is an indication of how much the leaving temperature will change when a capacity stage is either added or subtracted by using the two sensors, instead of the one used previously, the stage differentials can be automatically adjusted.

The basic logic for determining when to add or subtract a stage is basically a time-based integration of the deviation for the set point plus the rate of change of the leaving water temperature. Two basic equations are used to do this:

(1) $SUM = SUM + DT + (3 \times DTR)$ (2) $Z = 10 + (4 \times SD)$

Where $DT = LWT - \text{Set Point}$ (°F.)

$DTR = \text{Rate of change of } LWT$ (°F.)

$SD = (EWT - LWT)/\text{Stage \#}$

Each of the above equations is updated every 30 seconds. If the water temperature is above the set point and DTR is either zero or greater than zero then the sum will increase. When sum is equal to Z then a stage of capacity will be added and the sum will be set to zero. If the leaving water temperature is below the setpoint and DTR is less than or equal to zero, then the sum will gradually decrease. When the sum is less than $-Z$, a capacity stage will be removed. For example, assume that the following conditions exist:

Setpoint = 44

LWT32 46

EWT = 51

Stage = 4

DTR = 0

$$Z = 10 + (4 \times (51 - 46)/4) = 15$$

Starting at time 0 with sum equal to zero, then the following will occur every 30 seconds:

| TIME | SUM | Z |
|---|---|---|
| 0 | 0 | 15 |
| 30 | 2 | 15 |
| 60 | 4 | 15 |
| 90 | 6 | 15 |
| 120 | 8 | 15 |
| 150 | 10 | 15 |
| 180 | 12 | 15 |
| 210 | 14 | 15 |
| 240 | 16 | 15 |

At a time of 240 seconds (4 minutes) sum became greater than Z and a stage of capacity will be added. If the LWT is close to the set point, then the sum will increase slowly and the time delay between adding stages will be long. If the DT is large, then sum will increase quickly and the time delay will be short. If, for example, the temperature drop (DTR) is 2° F. then when a stage is added or subtracted the leaving temperature will quickly change by the 2° F. A "Z" factor is used to compensate for this. The drop is a function or cooler GPM, # Stage, ambient, and set point.

The above example was for a DTR of zero. The DTR is usually never zero in actual operation. The DTR is used to compensate for rapid changes in leaving water temperature. If DTR is small, then it will have little effect on sum, but if DTR is large then it can cause sum to increase quickly. This compensates for rapid LWT changes.

The above capacity logic will add and subtract the capacity stages to satisfy the load. The logic has several advantages over existing step controllers, some of which are (1) Simple Setup—One potentiometer vs. two potentiometers and no loop GPM adjustments, (2) Droopless Control—Independent of outdoor air temperature, loop GPM, and load, and (3) Variable control band to provide most accurate control without causing excessive compressor cycles.

The accessory reset board, shown in FIG. 2 has a reset limit set point potentiometer 33 and a reset ratio set point potentiometer 34, which are used in connection with the set point potentiometer 39 to allow the leaving water temperature sensed by T1 to be increased at part load conditions when the set point is colder than necessary to maintain the space temperature requirements. The return water reset allows the leaving water temperature set point to be varied automatically based on a change in the temperature drop through the chiller 16, which is a measure of the building load.

Figure 3A:
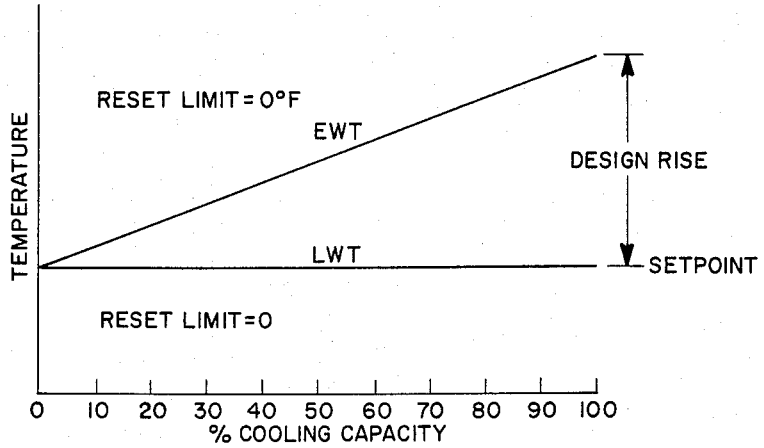
FIG. 3A is a graph of cooling water return temperature reset as a function of capacity with a reset ratio of 0%.
Figure 3B:
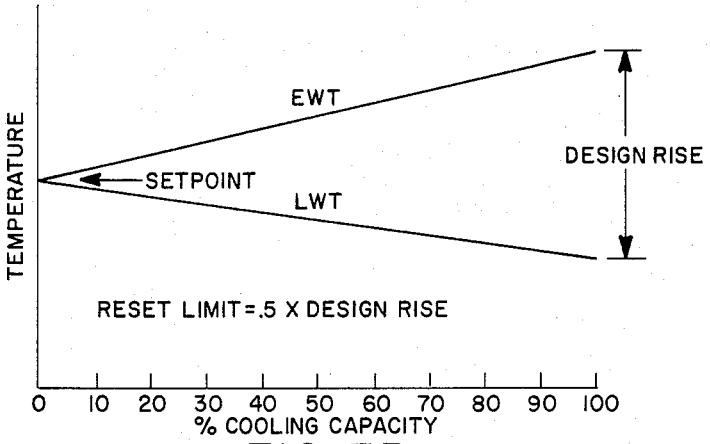
FIG. 3B is a graph of cooling water return temperature reset as a function of capacity with a reset ratio of 50%.

The amount of reset is adjusted by the reset ratio potentiometer 34 with a range of 0 to 100%. The reset limit potentiometer 33 is used to limit the maximum reset to a maximum value (0° to 80°F.). A standard chiller controls water as shown in FIG. 3A. If a reset ratio of 50% is selected, then the chiller will control the leaving water as shown in FIG. 3B. The control temperature is determined by the following equation:

$$\text{Control Temp.} = \text{Set Point} - (\text{EWT} - \text{LWT}) * \frac{\%\ \text{Reset}}{100}$$

Figure 3C:
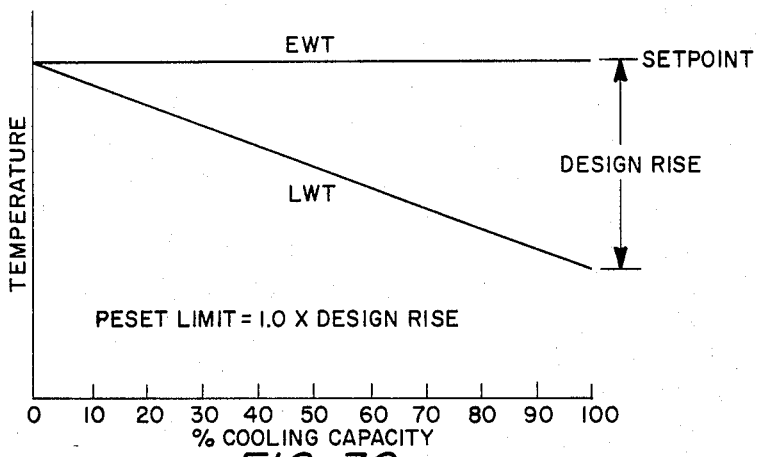
FIG. 3C is a graph of cooling water return temperature reset as a function of capacity with a reset ratio of 100%.

At part load this results in the chiller producing higher temperature water and thus operating at a higher efficiency. If a 100% reset ratio is selected, then the temperature will be controlled as shown in FIG. 3C.

This will also be used on heating applications with heat pump chillers. The only difference is that the following equation will be used to increase the heated water temperature as the load increases.

$$\text{Control Temp.} = \text{Set Point} - (\text{LWT} - \text{EWT}) * \frac{\%\ \text{Reset}}{100}$$

Figure 4A:
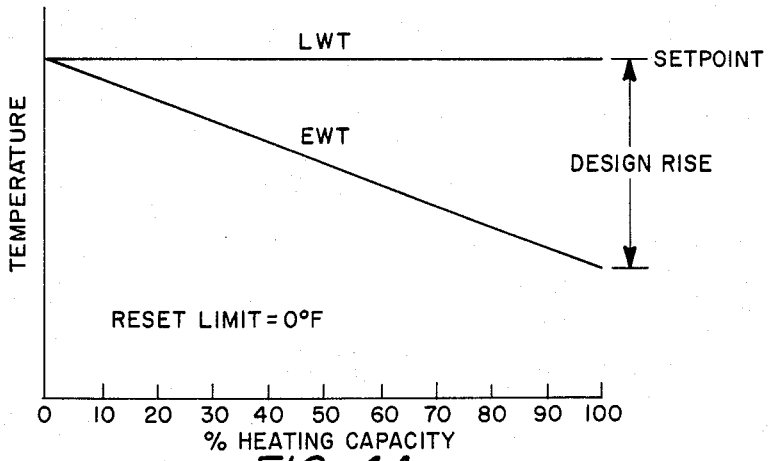
FIG. 4A is a graph of heating water return temperature reset as a function of capacity with a reset ratio of 0%.
Figure 4B:
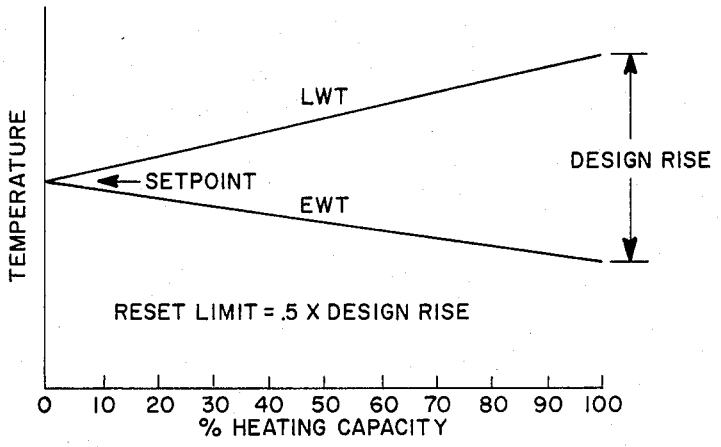
FIG. 4B is a graph of heating water return temperature reset as a function of capacity with a reset ratio of 50%.
Figure 4C:
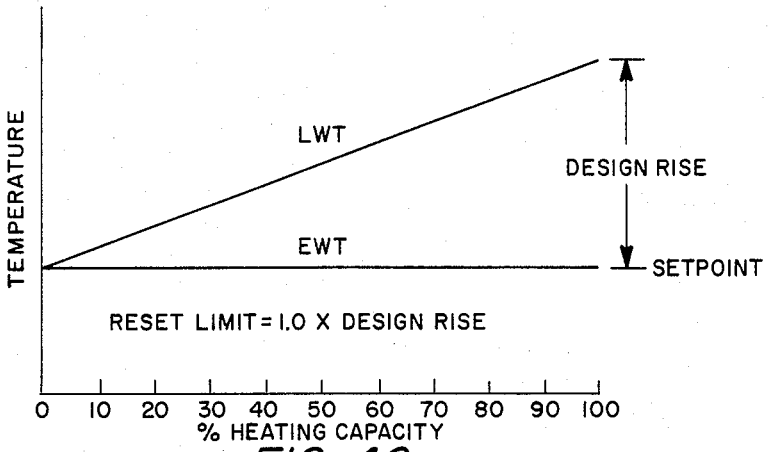
FIG. 4C is a graph of heating water return temperature reset as a function of capacity with a reset ratio of 100%.

The results for heating are shown in FIGS. 4A, 4B, and 4C.

What is claimed is:

1. A method of operating a refrigeration system including at least two refrigerant loops having a plurality of compressors in each loop for compressing gaseous refrigerant supplied to the compressors from an evaporator chiller comprising:

electrically connecting the outputs of a microprocessor control to the input controls of the compressors;

programming two complete reversed loading sequences for the compressors into said microprocessor;

selecting randomly one sequence to load the compressors to full load; and selecting randomly, when the compressors have reached full load, one sequence to unload the compressors.

* * * * *